United States Patent [19]

Benziger

[11] 3,985,595

[45] Oct. 12, 1976

[54] INSENSITIVE EXPLOSIVE COMPOSITION OF HALOGENATED COPOLYMER AND TRIAMINOTRINITROBENZENE

[75] Inventor: Theodore M. Benziger, Santa Fe, N. Mex.

[73] Assignee: The United States of America as represented by the United States Energy Research and Development Administration, Washington, D.C.

[22] Filed: Nov. 29, 1974

[21] Appl. No.: 528,380

[52] U.S. Cl. ..... 149/19.3; 149/105; 260/645

[51] Int. Cl.[2] ..... C06B 45/10; C06B 25/04; C07C 79/10

[58] Field of Search ..... 149/19.3, 105, 99, 103, 149/106, 107; 260/645

[56] References Cited

UNITED STATES PATENTS

| | | | |
|---|---|---|---|
| 3,173,817 | 3/1965 | Wright | 149/105 |
| 3,296,041 | 1/1967 | Wright | 149/105 |
| 3,728,170 | 4/1973 | Stott | 149/105 |
| 3,755,471 | 8/1973 | Dacons | 260/645 |

*Primary Examiner*—Samuel W. Engle
*Assistant Examiner*—Donald P. Walsh
*Attorney, Agent, or Firm*—Dean E. Carlson; Edward C. Walterscheid

[57] ABSTRACT

A highly insensitive and heat resistant plastic-bonded explosive containing 90 wt % triaminotrinitrobenzene and 10 wt % of a fully saturated copolymer of chlorotrifluoroethylene and vinylidene fluoride is readily manufactured by the slurry process.

1 Claim, No Drawings

INSENSITIVE EXPLOSIVE COMPOSITION OF HALOGENATED COPOLYMER AND TRIAMINOTRINITROBENZENE

BACKGROUND OF THE INVENTION

The invention described herein was made in the course of, or under, a contract with the U.S. Atomic Energy Commission. It relates to high explosives and more particularly to highly insensitive, plastic-bonded explosives which may also be highly heat resistant. New requirements for high explosives have appeared in many applications of modern ordnance, particularly in the areas of high-temperature service and resistance to accidental initiation. This last factor is of special concern in nuclear weapons because of the environmental hazards associated with an explosive dispersal of radioactive material, such as may occur in fires, plane crashes, or accidental air drops of weapons. Accordingly, an explosive composition having the following properties is quite desirable: (a) high thermal stability, (b) nonexplosive degradation in fire situations, (c) high resistance to shock initiation, and (d) a reasonable explosive performance. Additionally, such a heat-resistant, insensitive explosive should be capable of being readily formed into the varied shapes required in modern ordnance and should have a sufficient strength to retain its structural integrity under rather severe thermal and impact conditions.

Plastic-bonded explosives represent a class of explosives which can be made into pressings from which can be fabricated —usually by machining —desired shapes. These explosives are pressed from so-called molding powders which are typically prepared by the slurry technique. Powdered explosive and water are mixed in a kettle equipped with a condenser and agitator. A lacquer composed of the plastic (together with a plasticizer, if necessary) dissolved in a suitable solvent is added to the slurry. The solvent is removed by distillation, causing the plastic phase to precipitate out on the explosive. The plastic-explosive agglomerates into "beads" as the stirring and solvent removal continues. Finally, water is removed from the beads by filtration and drying; the resultant product is the molding powder. The powder is then pressed into shape by either compression molding with steel dies or hydrostatic or isostatic pressing under vacuum. The pressing may readily be machined into a desired shape for actual use.

DEFINITION OF TERMS

As used within this application, HMX is an explosive having the chemical name 1,3,5,7-tetranitro-1,3,5,7-tetraazacyclooctane also designated as cyclotetramethylene-tetranitramine; TATB is sym-triaminotrinitrobenzene; TCB is 1,3,5-trichlorobenzene; TCTNB is 1,3,5-trichloro-2,4,6-trinitrobenzene; Kel-F 800 is a trade name for a fully saturated copolymer of chlorotrifluoroethylene and vinylidene fluoride manufactured by the 3M Corporation; Kel-F 827 is a high molecular weight version of Kel-F 800; Elvanol 52-22 is a trade name for a polyvinyl alcohol resin manufactured by E.I. DePont de Nemours and Co.

SUMMARY OF THE INVENTION

A plastic-bonded explosive composition which is heat-resistant and highly insensitive comprises the explosive compound TATB with a halogenated plastic binder. A preferred binder is Kel-F 800 or its high molecular weight counterpart, Kel-F 827. The binder content of the explosive composition of this invention may vary from 5 to 10%, but a preferred ratio of explosive to binder is 90:10.

If thermal stability of the explosive composition is not critical, and if improved explosive performance is desired, the TATB content may be reduced and an additional explosive compound added while maintaining the binder content constant. A suitable additive explosive compound for this purpose is HMX.

DESCRIPTION OF THE PREFERRED EMBODIMENTS

The explosive compound TATB is readily manufactured according to the following steps:

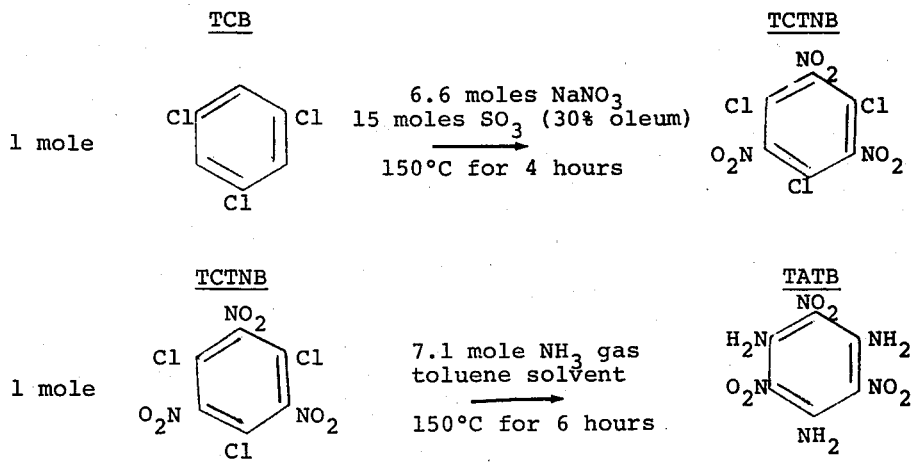

It has the properties shown in Table I. In addition, a striking feature of TATB is its lubricity, associated with its graphite like structure. As a result, TATB formulations press quite readily to high density even in difficult operations such as flash-semipositive or transfer molding.

TABLE I

| | |
|---|---|
| Crystal density, $\rho_c$ (g/cm$^3$) | 1.938 |
| Heat of formation, $\Delta H_f$ (kcal/mole)* | − 36.85 |
| Heat of detonation at $\rho_c$, calc | |

TABLE I-continued

| | |
|---|---|
| (cal/g)* | 829 |
| C-J pressure at $\rho_c$, calc (kbar) | 313 |
| C-J pressure, plate-dent value at 1.870 g/cm³ (kbar) | 277 |
| Cylinder-test value at 1.863 g/cm³ (9404 = 1.00) | 0.67 |
| Detonation velocity at $\rho_c$, calc (m/sec) | 7970 |
| Detonation velocity at 1.857 g/cm³, exptl (m/sec) | 7606 |
| Drop-weight impact test, 12/12B (cm) | > 320 |
| Friction test (sliding rod) | No reaction |
| Spark sensitivity, LASL** test, 0.010-in. Pb foil (J) | 11.29 at 25°C<br>6.75 at 150°C |
| Gap sensitivity at 1.870 g/cm³, 1⅝-in. diam (in Dural) | 0.863 |
| DTA exotherm (°C) | 330 |
| Vacuum stability (ml/g/48 h) | 0.5 at 200°C<br>2.3 at 220°C |
| Decomposition kinetics constants | |
| E (kcal/mole) | 59.8 |
| Z (sec⁻¹) | $3.18 \times 10^{19}$ |
| Solubility in organic solvents | Nil |

*Naval Ordnance Laboratory values
**Los Alamos Scientific Laboratory

A suitable binder for a heat-resistant TATB composition exhibits chemical resistance, thermal stability, high density, elastomeric properties, and solubility characteristics enabling the use of the slurry process in preparing molding powder. These requirements essentially limit the choice of one to the halogenated plastics. By halogenated plastics are meant fully saturated copolymers of vinylidene fluoride and, e.g., hexafluoropropylene or chlorotrifluoroethylene. Preferred binders are the halogenated plastics sold under the trade names Kel-F 800 and Kel-F 827. Kel-F 800 has the following properties.

| | |
|---|---|
| Density | 2.02 g/cm³ |
| Molding temperature | 300°F |
| Tensile strength | 1500 psi |
| Elongation | 350% |
| Hardness (Shore D) | 64 |
| Solubility | Esters, Ketones |

The binder content may vary from 5 to 10 wt %; however, a preferred content is 10 wt %.

A molding powder containing 90 wt % TATB and 10 wt % Kel-F 800 is readily made in accordance with the following procedure. A slurry of TATB in water is prepared by mixing 31.5 lb of powdered TATB in 20 gal of water. A Kel-F 800 lacquer is prepared by dissolving 3.5 lb of Kel-F 800 in 2 gal of butyl acetate. The TATB/$H_2O$ slurry is heated to 75° C, with agitation, in a 40-gal kettle and the Kel-F 800 lacquer heated to 40° C is added. The resultant dispersion is heated with a steam sparger to distill the solvent as the butyl acetate/-water azeotrope. The sparger is used to reduce the exposed heating surface because during the formation of the molding powder granules the mixture adheres strongly to heated surfaces.

During solvent removal, when individual particles begin to form, 280 ml of a 10% solution of Elvanol 52-22 in water is added. The Elvanol 52-22 acts as a protective colloid to control the molding-powder particle size. The degree of agitation of the dispersion also effects particle size. Accordingly, agitation is preferably reduced during the solvent removal step.

Heating is continued until the kettle temperature exceeds the initial azeotrope boiling point by 2.5°–3.0°

C. The dispersion is then cooled to 40° C and filtered. Finally, the resultant powder is dried at 100° C in a forced draft oven. This produces 35 lb of 90 wt % TATB-10 wt % Kel-F 800 having a bulk density of approximately 0.9 g/cm³.

High-density charges of this 90 wt % TATB-10 wt % Kel-F 800 may readily be formed by compression molding at temperatures above 100° C. This is illustrated by the results of pressing trials on small charges given in Table II.

TABLE II

| |
|---|
| Samples: 2-in.-diam × 1-in.-high cylinders |
| Evacuation pressure: 0.5 mm Hg |
| Molding pressure: 20,000 psi |
| Theoretical maximum density: 1.946 g/cm³ |
| Pressed Densities: |
| 100°C/3 intensifications - 1.921 g/cm³ |
| 120°C/1 intensification - 1.919 g/cm³ |
| 120°C/3 intensifications - 1.921 g/cm³ |

In pressing larger pieces (6-in.-diam x 4-in.-high cylinders) at 120° C and 20,000 psi with three intensifications, a density of 1.920 g/cm³ can be obtained. This is 98.7% of the theoretical maximum. High densities may be obtained with a pressure as low as 10,000 psi when a temperature of 150° C is used.

Molded pieces of this formulation can be machined quite readily to precise dimensions. The TATB apparently acts as a lubricant in such operations.

Performance data for this 90 wt % TATB-10 wt % Kel-F 800 plastic bonded explosive are given in Table III. Conventional thermal stability data for it are as follows:

| | |
|---|---|
| DTA exotherm (°C) | 330 |
| Vacuum stability (ml/g/48 h) | |
| at 150°C | 0.05 |
| at 200°C | 0.40 |
| at 220°C | 2.90 |

TABLE III

| | |
|---|---|
| Theoretical density (g/cm³) | 1.946 |
| Typical pressed density (g/cm³) | 1.920 |
| Detonation velocity, 1⅝-in. diam (m/sec) | 7,534 |
| Failure diam (in.) | 0.6–0.8 |
| $P_{CJ}$, calc, 0.258 $\rho$ $D^2$(kbar) | 282 |
| $P_{CJ}$, plate-dent comparison (kbar) | 270 |
| Cylinder-test comparison (PBX-9404 = 1.00) | 0.68 |

Strength values for this explosive are given in Table IV. Higher strength composites may readily be made by replacing all or part of the Kel-F 800 binders with Kel-F 827.

A wide variety of sensitivity tests, including bullet impact, Susan, $P^2\tau$, and impact tests, show that a composition of 90 wt % TATB and 10 wt % Kel-F 800 ranks as one of the most shock-resistant explosives known. Thus, for example, the boundary betwen no reaction and a vigorous explosive reaction for a given explosive is given by the relation $P^2\tau$ = constant, where P is the shock pressure (kbar and $\tau$ is its duration (usec). The art reveals that this $P^2\tau$ value may be considered as proportional to a critical ignition energy. The following sensitivity rankings demonstrate the exceedingly high shock resistance of this explosive composition.

TABLE IV

PHYSICAL PROPERTIES OF X-0219

| | Temperature (°F) | Yield Stress (psi) | Ultimate Stress (psi) | Modulus ($10^5$ psi) |
|---|---|---|---|---|
| Compressive | 0 | 1750 | 5020 | 5.7 |
| | 75 | 980 | 3140 | 5.2 |
| | 120 | 600 | 1800 | 3.4 |
| | 165 | 410 | 1240 | 1.9 |
| Tensile | 0 | 420 | 1530 | 8.4 |
| | 75 | 400 | 1020 | 4.5 |
| | 120 | 210 | 710 | 1.7 |
| | 165 | 150 | 450 | 1.9 |
| Shear | 0 | 1880 | 2370 | |
| | 75 | 1450 | 1670 | |
| | 120 | 760 | 1020 | |
| | 165 | 520 | 520 | |

| Explosive | $P^2\tau$ (kbar$^2$-$\mu$sec) | P (kbar) for 1-$\mu$sec pulse |
|---|---|---|
| 90 wt %.TATB-10 wt % Kel-F 800 | 23,000 | 150 |
| Composition B | 700 | 26 |
| PBX-9404 | 540 | 23 |

Improved explosive performance may be obtained by maintaining the binder content constant, lowering the content of TATB, and adding a more powerful explosive compound. This has the effect of lowering the thermal stability but increasing performance while yet maintaining the insensitivity produced by the TATB. Thus, for example, in an HMX/TATB/Kel-F 800 system with the binder content held at 10 wt %, explosive power can easily be controlled over a considerable range of composition. Cylinder-test values (PBX 9404 = 1.00) vary linearly from 0.66 to 0.97 as the composition is varied from 0/90/10 to 90/0/10. The effect of TATB content on sensitivity is demonstrated in skid tests (45°, sandpaper targets). At TATB contents of 0 to 20 wt %, the 50 % height is a few feet; at 40 wt % TATB, however, no explosive reactions can be obtained even with drop heights as great as 64 ft.

What I claim is:

1. A highly insensitive, heat resistant plastic bonded explosive comprising about 90 wt% of triaminotrinitrobenzene and about 10 wt% of a fully saturated copolymer of chlorotrifluoroethylene and vinylidene fluoride.

* * * * *